US005916330A

United States Patent [19]

Jacobson

[11] Patent Number: 5,916,330

[45] **Date of Patent: *Jun. 29, 1999**

[54] CABLE OPERATED RELEASABLE BRAKE PEDAL ASSEMBLY

[75] Inventor: Alan Lawrence Jacobson, Farmington Hills, Mich.

[73] Assignee: Ford Global Technologies, Inc., Dearborn, Mich.

[ * ] Notice: This patent issued on a continued prosecution application filed under 37 CFR 1.53(d), and is subject to the twenty year patent term provisions of 35 U.S.C. 154(a)(2).

[21] Appl. No.: 08/783,681

[22] Filed: Jan. 15, 1997

[51] Int. Cl.[6] ..... G05G 1/14

[52] U.S. Cl. ..... 74/512; 74/560

[58] Field of Search ..... 74/512, 513, 518, 74/560, 516

[56] References Cited

U.S. PATENT DOCUMENTS

| | | | |
|---|---|---|---|
| 2,164,921 | 7/1939 | Hoff | 74/512 X |
| 3,108,651 | 10/1963 | Miller . | |
| 3,125,896 | 3/1964 | Beisel et al. . | |
| 3,128,859 | 4/1964 | Griffen . | |
| 3,132,567 | 5/1964 | Ingres et al. . | |
| 4,192,399 | 3/1980 | Otteson et al. | 74/512 X |
| 4,224,832 | 9/1980 | Prohaska et al. | 74/512 |
| 4,621,538 | 11/1986 | Senft et al. . | |

FOREIGN PATENT DOCUMENTS

| | | | |
|---|---|---|---|
| 2555333 | 5/1985 | France | 74/512 |
| 5-85220 | 4/1993 | Japan | 74/512 |
| 2116399 | 10/1971 | United Kingdom | 74/512 |
| 4139496 | 6/1992 | United Kingdom | 74/512 |

OTHER PUBLICATIONS

SAE Journal, vol. 70 #9, p. 80, Sep. 1962.

*Primary Examiner*—Vinh T. Luong
*Attorney, Agent, or Firm*—Daniel M. Stock

[57] ABSTRACT

A brake pedal assembly includes a two-piece pedal having an upper arm 44 and a lower arm 46 pivotably mounted with respect to each other and drivingly engaging a brake actuator piston rod 26. The upper arm 44 is cable connected to a brake actuator assembly 20 and is ineffective to transmit compressive loads longitudinal of the vehicle. Imposition of intrusive forces longitudinal of the vehicle can pivot the lower arm 46 upwardly toward a horizontal position.

3 Claims, 2 Drawing Sheets

CABLE OPERATED RELEASABLE BRAKE PEDAL ASSEMBLY

BACKGROUND OF THE INVENTION

1. Technical Field

The present invention relates generally to brake pedal assemblies, and more specifically to a brake pedal assembly that is releasable from an operative condition upon imposition of a frontal load to an automotive vehicle.

2. Description of Related Art

It is well known in the automotive vehicle design arts that it is desirable to configure components arrayed within the passenger compartment of the vehicle to reduce adverse effects on the vehicle occupants when subjected to high intrusion forces such as are experienced in a collision.

While most attention has been given to the design of vehicle interior components immediately facing the vehicle occupants, including steering wheels, instrument panels, door and pillar trim, and headliners, the design solutions provided for those components have been found not to be suitable for dealing with another set of common components such as foot pedals, generally positioned below the instrument panel of the vehicle at the driver's compartment.

One treatment in the related art to accommodate pedal structure in a vehicle for intrusive loads is that of U.S. Pat. No. 4,621,538, to Senft et al. This patent deals with a foot operated parking brake which utilizes pivotal movement of the pedal to respond to intrusive forces. For brake, clutch, and accelerator pedals, however, and in particular for service brake pedals, the solution of the '538 patent is inapt because the parking brake is rotatably actuated and is not required to deal with the axial driving of the piston rod of a brake master cylinder toward the foot operated pedal, as is the case in many common service brakes.

SUMMARY OF THE INVENTION

Responsive to the deficiencies of the prior art, a releasable brake pedal assembly is provided, which includes an elongated pedal pivotally mounted to the dash panel of the vehicle with a cable connection between a portion of the pedal above the pivotal connection of the dash panel and the brake actuator piston rod of the vehicle to effect the operation of the vehicle brakes. Intrusive forces tending to move the brake actuator assembly toward the pedal assembly are not transmitted to the passenger compartment through the dash panel in this embodiment because of the cable connection is ineffective to transmit compressive loads applied longitudinally of the vehicle.

Also responsive to the cited deficiency in the related art, the present invention provides a releasable brake pedal assembly which includes an elongated pedal with an upper arm having an upper end pivotally mounted with respect to the vehicle's dash panel, and a lower arm having an upper end pivotally mounted to the lower end of the upper arm. A drivingly engaging connection between the upper arm and the brake actuator piston rod is positioned vertically intermediate the pivotal connections of the upper arm to the dash panel and the lower arm to the upper arm.

According to a feature of the invention, the lower arm is pivotally movable between a vertical position in which it abuttingly engages the upper arm for actuating movement with rotative movement toward horizontal positions limited in travel by the underside of the instrument panel or bolster.

According to another advantageous feature, the lower arm may be resiliently biased toward vertical orientation with the upper arm.

BRIEF DESCRIPTION OF THE DRAWINGS

Other advantages and features of the tailgate construction of the present invention will be apparent to those skilled in the automotive vehicle arts upon reading the following description with reference to the accompanying drawings, in which.

DESCRIPTION OF THE PREFERRED EMBODIMENTS PRIOR ART

Figure 1:
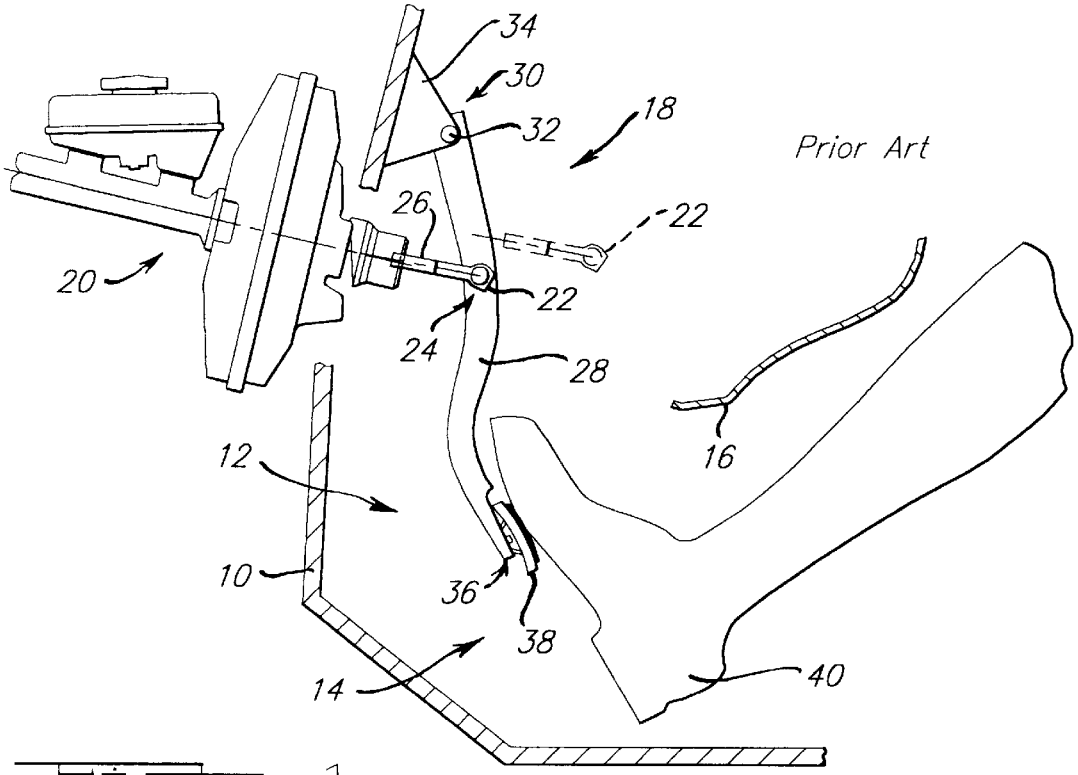
FIG. 1 is a diagrammatic view of the brake pedal assembly, of conventional design, used in cooperation with a brake master cylinder assembly.

Turning now to the drawings, and in particular to FIG. 1 thereof, which depicts a prior art brake pedal assembly for purposes of illustrating the environment of the present invention, a portion of an automobile is illustrated as including a body having a dash panel 10 providing a forward boundary of the passenger compartment, indicated generally at 12, defining a foot portion, indicated at 14. The foot portion 14 is bounded at its upper side by the underside of an instrument panel, indicated at 16, which may typically be the knee bolster area of the instrument panel. A brake pedal assembly, indicated at 18, is illustrated as being operatively engaged with the brake actuator assembly 20 The pedal assembly preferably includes a pocket such as the socket of ball and socket joint 22, which receives an end 24 of the brake actuator piston rod 26. The pedal assembly 18 includes an elongated pedal 28 having an upper end 30 pivotally mounted, as indicated at 32, to a trunion 34 secured to the dash panel 10. Proximate the lower end 36 of the pedal 28, a foot plate 38 is configured to be engageable with the foot 40 of the vehicle operator to pivot the pedal 28 clockwise, as shown in FIG. 1, to drive the brake actuator piston rod 26 toward the brake actuator assembly 20 to actuate the vehicle brakes in a known manner. Upon imposition of the substantial intrusive force, the brake actuator piston rod 26 may be driven rearwardly with respect to the vehicle to the dotted line position shown in FIG. 1 translating and pivoting the pedal assembly 18 with it. If the foot 40 of the occupant separates from the foot pad 38, the pedal 28 may be driven up over the foot.

DESCRIPTION OF THE INVENTION PEDAL ASSEMBLY

Figure 2:
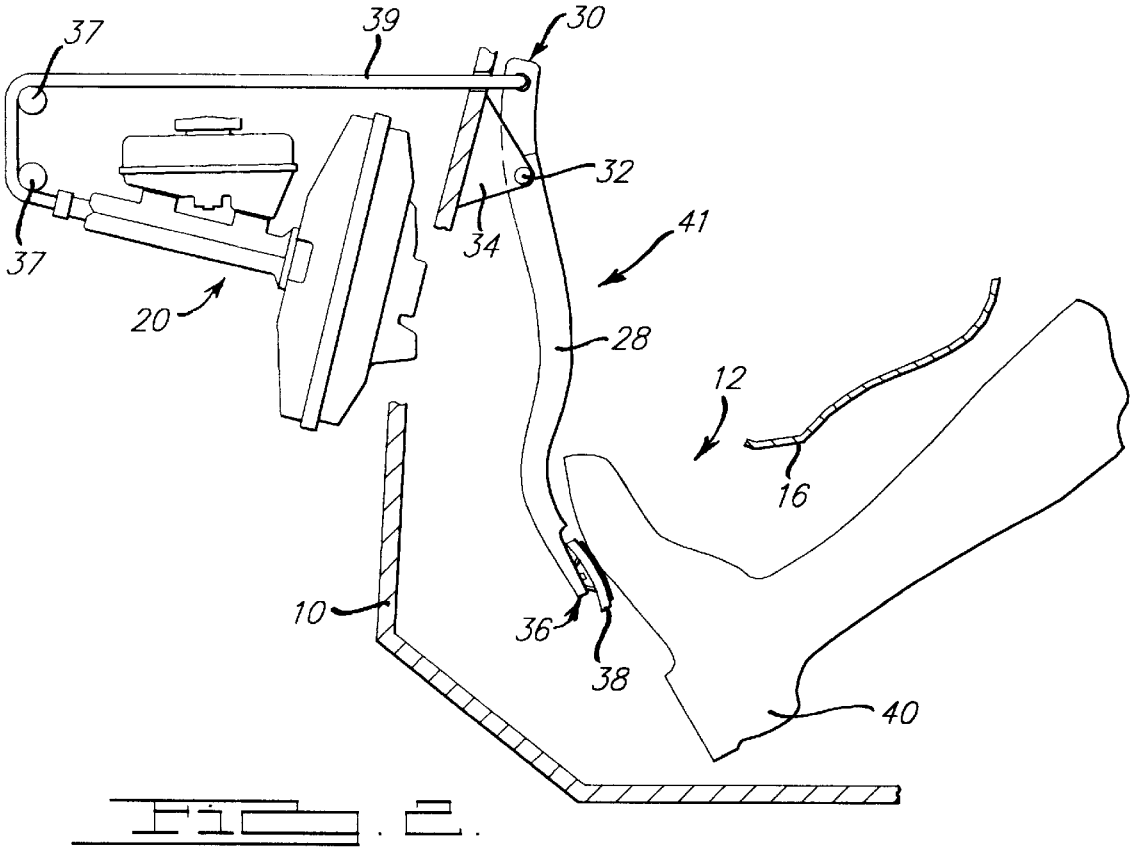
FIG. 2 is a diagrammatic view similar to FIG. 1 showing the releasable brake pedal assembly of the present invention in its normal operative position and the position utilizing a cable connection to actuate a brake actuator assembly.

To combat the mechanics of the high intrusion forces, an improved pedal assembly 42, as may best be seen in FIG. 2, may be provided. The pedal assembly 41 differs from the pedal assembly 18 in that the elongated pedal 28 is operatively connected to the brake actuator assembly 20 by a flexible cable 39 wound over pulleys 37. No driving engagement with the brake actuator assembly is effected. The flexibility of the cable 39 ensures that the pedal 28 may freely pivot upwardly toward the bolster 16.

Figure 3:
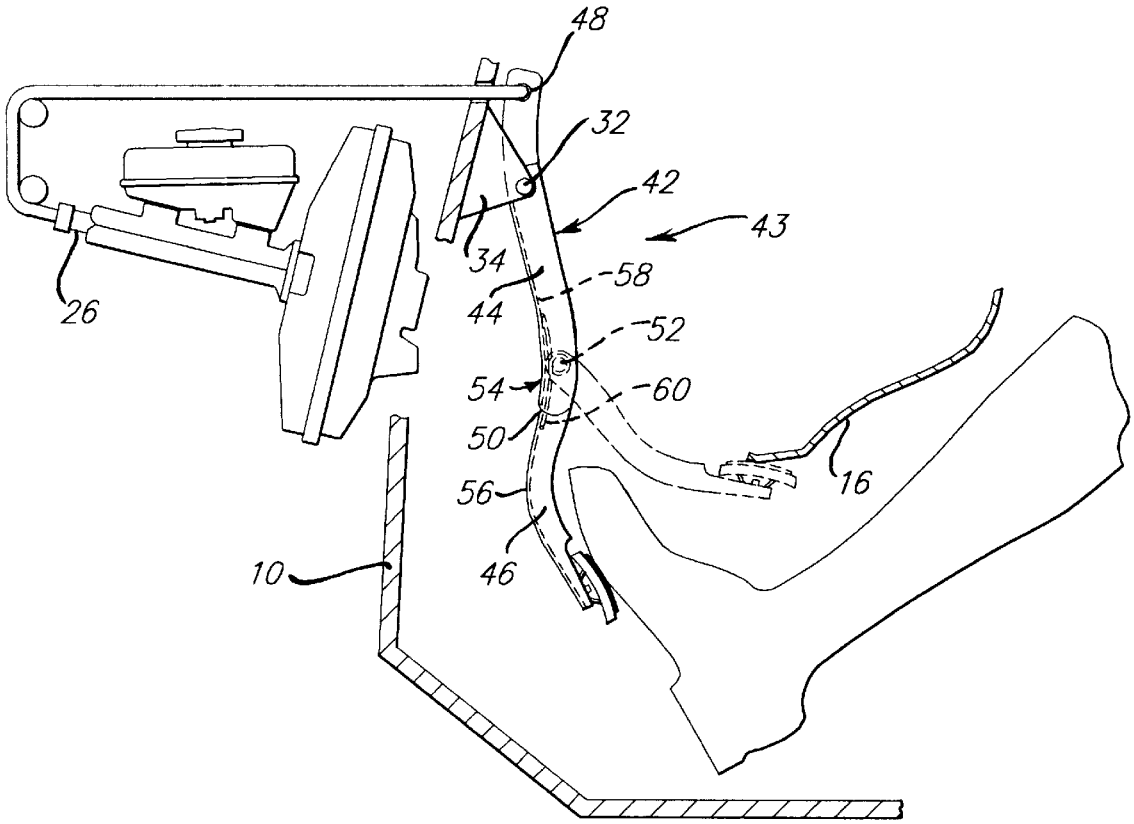
FIG. 3 is a diagrammatic view similar to FIG. 2 showing an alternative embodiment.

According to the alternative embodiment shown in FIG. 3, the pedal assembly 41 may be replaced by another pedal assembly 43 embodying an articulated pedal 42 having an upper arm 44 and a lower arm 46. The upper arm 44 is pivotally connected at 48 to the trunion 34 by which it is mounted to the dash panel 10, and the lower arm 46 is pivotally mounted at 52 proximate the lower end 50 of the upper arm 44 and may be nested inside it in channel-like mating, as indicated in FIG. 2. The cable 39 is connected to upper arm 44 at a position above the pivotal connection 48 of the upper arm 42 to the dash panel 10. High intrusive forces imposed on the brake actuator assembly 20 or along its longitudinal extent will tend to drive the pedal counterclockwise, but pivotal freedom at the lower pivot 52 permits upward swinging movement of the lower arm 46, until the foot plate 38 reaches the position in which it engages the bolster 16 and upper arm 44 is also free to pivot counterclockwise in absence of resistance by the cable 39.

Counterclockwise movement of the lower arm 46 is limited by cooperation between mechanical abutments, indicated generally at 54, between the forward face 56 of the lower arm 46 and the inner face 58 of the upper arm 44. A spring, as indicated at 60, may be provided to urge the lower arm 46 toward the substantially vertical position shown in solid line in FIG. 2, so that after an event in which high intrusive forces are encountered, the pedal will return to the operative position shown.

While only two embodiments of the invention pedal assembly has been described, others may occur to those skilled in the automotive mechanical arts which do not depart from the scope of the following claims.

I claim:

1. A releasable brake pedal assembly for an automobile having a body defining a passenger compartment, the passenger compartment having a pedal portion in which the pedal is operatively engageable by the foot of an operator, the pedal portion being bounded on its forward end by a generally vertical dash panel and on its upper end by a generally horizontal bolster, the automobile further having a brake actuator piston rod for actuating the brakes of the vehicle, the brake pedal assembly comprising:

an elongated pedal assembly having:

an upper arm having an upper end pivotally mounted with respect to the dash panel at an upper pivot axis and a lower end;

a lower arm having an upper end pivotally connected to said upper arm proximate said upper arm lower end at a lower pivot axis in a first position and being pivotally movable in one direction to other positions;

a spring resiliently biasing said lower arm toward said first position;

a cable having one end secured to said upper arm upper end and another end secured to said brake actuator piston rod; and means for pivotally mounting the elongated pedal upper arm to the dash panel whereby pedal movement of said elongated pedal in one direction acts on said brake actuator piston rod and wherein opposite pivotal movement of said upper arm is free.

2. A releasable brake pedal assembly as defined in claim 1, wherein said upper arm and said lower arm include cooperating surfaces preventing relative rotational movement from said first position away from said other positions.

3. A releasable brake pedal assembly as defined in claim 2, wherein said cooperative surfaces permit said relative rotational movement upon imposition of substantial load.

* * * * *